US006996939B1

(12) United States Patent
Jackson

(10) Patent No.: US 6,996,939 B1
(45) Date of Patent: Feb. 14, 2006

(54) MOBILE ROOM PARTITION SYSTEM WITH CENTRAL CONNECTING PANEL AND LATERAL STORAGE UNITS

(76) Inventor: Herbert Jackson, 9219 Gary La., Springdale, MD (US) 20774

( * ) Notice: Subject to any disclaimer, the term of this patent is extended or adjusted under 35 U.S.C. 154(b) by 296 days.

(21) Appl. No.: 10/410,045

(22) Filed: Apr. 9, 2003

(51) Int. Cl.
*E04F 19/00* (2006.01)

(52) U.S. Cl. ..... 52/36.4; 52/65; 52/70; 52/71; 52/239; 160/351; 312/140.2; 312/258; 312/265; 312/223.3; 312/314; 312/249.8; 49/372

(58) Field of Classification Search ..... 312/140.2, 312/258, 265, 223.3, 314, 249.8; 52/65, 52/70, 71, 239, 36.4; 160/351; 49/372
See application file for complete search history.

(56) References Cited

U.S. PATENT DOCUMENTS 1,133,866 A * 3/1915 Leighty ..... 312/240
D247,696 S 4/1978 Eisen
4,099,809 A * 7/1978 Leotta ..... 312/140.2
4,161,850 A * 7/1979 Peterson et al. ..... 52/65
4,177,612 A 12/1979 Tochihara
4,569,163 A * 2/1986 Long ..... 52/36.1
4,870,908 A * 10/1989 Wolters et al. ..... 108/60
5,038,539 A 8/1991 Kelly et al.
5,687,513 A * 11/1997 Baloga et al. ..... 52/32
5,906,079 A 5/1999 Brickner et al.
6,048,044 A * 4/2000 Biggel et al. ..... 312/258
6,053,588 A * 4/2000 Biggel et al. ..... 312/249.8

* cited by examiner

*Primary Examiner*—Carl D. Friedman
*Assistant Examiner*—Yvonne M. Horton
(74) *Attorney, Agent, or Firm*—Goldstein Law Offices, PC.

(57) ABSTRACT

A room partition system for a room having a central connecting panel and hingeably attached, foldable lateral storage units. Each of the lateral storage units has a bottom-mounted wheel assembly, thereby allowing the partition system to be rolled to various locations within the room. The lateral storage units have a plurality of shelves and provide substantial storage volume for containment of various items of clothing and other accessories. The lateral storage units are attached by hinges to the central connecting panel, thereby allowing a user to fold the storage units partially or fully against the connecting panel. The partition system has an open position, wherein the storage units extend parallel to the connecting panel, and also a folded position, wherein each lateral storage unit is rotated upon its hinges to a position perpendicular to that of the connecting panel, thereby forming a partially enclosed area for use as an entertainment center, a study center, or a work center.

3 Claims, 5 Drawing Sheets

MOBILE ROOM PARTITION SYSTEM WITH CENTRAL CONNECTING PANEL AND LATERAL STORAGE UNITS

BACKGROUND OF THE INVENTION

1. Field of the Invention

The invention generally relates to a room partition system for dividing a room into separate areas, and in particular it relates to a room partition system with a central connecting panel and lateral storage units. While the room partition portion may be transformed and reconfigured in different locations with a room, the storage units are quipped with a plurality of wheels to allow the units to be selectively rolled to various locations.

2. Description of the Related Art

A variety of room partition systems have been devised for dividing a room into separate areas. For example, U.S. Pat. No. 5,038,539 to Kelley appears to show a room partition system having a rigid framework formed of rectangular frames joined together at the edges. Accordingly, Kelley fails to provide a flexible room partition system which may be folded as needed.

Additionally, U.S. Pat. No. 5,906,076 to Brickner appears to show a room partition system having a frame having brackets for containment of a markerboard. However, Brickner rigidly defines an enclosed work area, and therefore suffers from the same limitation as does Kelley.

Furthermore, U.S. Pat. No. 4,177,612 to Tochihara appears to show a room partition system that is used to define an enclosed space for use in a beauty salon. Moreover, U.S. Pat. No. D247,696 to Eisen appears to show an ornamental design for a room partition system.

None of these devices appears to show a room partition system having a central connecting panel and hingeably attached, foldable lateral storage units having bottom-mounted wheel assemblies for selectively rolling the storage units to various locations within a room. While these units may be suitable for the particular purpose employed, or for general use, they would not be as suitable for the purposes of the present invention as disclosed hereafter.

SUMMARY OF THE INVENTION

It is an object of the invention to provide a room partition system for providing an additional enclosed area within a room. Accordingly, the room partition system has a central connecting panel and two lateral storage units which are vertically positioned upon the floor of an existing room, thereby providing an additional enclosed area within the room.

It is another object of the invention to provide a room partition system which may be folded as per the wishes of a user. Accordingly, the central connecting panel is attached by hinges to the two lateral storage units, thereby allowing the lateral storage units to be selectively folded, partially or fully, against the central connecting panel.

It is yet another object of the invention to provide a room partition system which may be easily moved to different locations within the room. Accordingly, the storage units have bottom-mounted wheel assemblies, thereby allowing the room partition system to be easily rolled to different locations within the room.

It is an additional object of the invention to provide a room partition system which may be used as an entertainment center. Accordingly, each lateral storage unit has at least one middle slot for selectively removably accepting a connecting shelf therebetween when the storage units are perpendicular to the central connecting panel and facing each other. For that reason, any such 'pair' of middle slots are located at the same height on their respective storage units. Additional connecting shelves may be used for holding a television set, a stereo system, a compact disk player, a videocassette recorder, and a DVD player, thereby allowing use of the room partition system as an entertainment center.

It is a further object of the invention to provide a room partition system which may be used as a wardrobe organizer. Accordingly, the lateral storage units have a plurality of horizontal shelves, and provide substantial storage volume for containment therein of various items of clothing, thereby allowing use of the room partition system as a wardrobe organizer.

It is another object of the invention to provide a room partition system which is well-lighted. Accordingly, the room partition system has shelves which are configured for accepting lighting fixtures, thereby providing a partition system which is well-lighted.

The invention is a room partition system for a room having a central connecting panel and hingeably attached, foldable lateral storage units. Each of the lateral storage units has a bottom-mounted wheel assembly, thereby allowing the partition system to be rolled to various locations within the room. The lateral storage units have a plurality of shelves and provide substantial storage volume for containment of various items of clothing and other accessories. The lateral storage units are attached by other. For that reason, any such 'pair' of middle slots are located at the same height on their respective storage units. Additional connecting shelves may be used for holding a television set, a stereo system, a compact disk player, a videocassette recorder, and a DVD player, thereby allowing use of the room partition system as an entertainment center.

It is a further object of the invention to provide a room partition system which may be used as a wardrobe organizer. Accordingly, the lateral storage units have a plurality of horizontal shelves, and provide substantial storage volume for containment therein of various items of clothing, thereby allowing use of the room partition system as a wardrobe organizer.

It is another object of the invention to provide a room partition system which is well-lighted. Accordingly, the room partition system has shelves which are configured for accepting lighting fixtures, thereby providing a partition system which is well-lighted.

The invention is a room partition system for a room having a central connecting panel and hingeably attached, foldable lateral storage units. Each of the lateral storage units has a bottom-mounted wheel assembly, thereby allowing the partition system to be rolled to various locations within the room. The lateral storage units have a plurality of shelves and provide substantial storage volume for containment of various items of clothing and other accessories. The lateral storage units are attached by hinges to the central connecting panel, thereby allowing a user to fold the storage units partially or fully against the connecting panel. The partition system has an open position, wherein the storage units extend parallel to the connecting panel, and also a folded position, wherein each lateral storage unit is rotated upon its hinges to a position perpendicular to that of the connecting panel, thereby forming a partially enclosed area for use as an entertainment center, a study center, or a work center.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
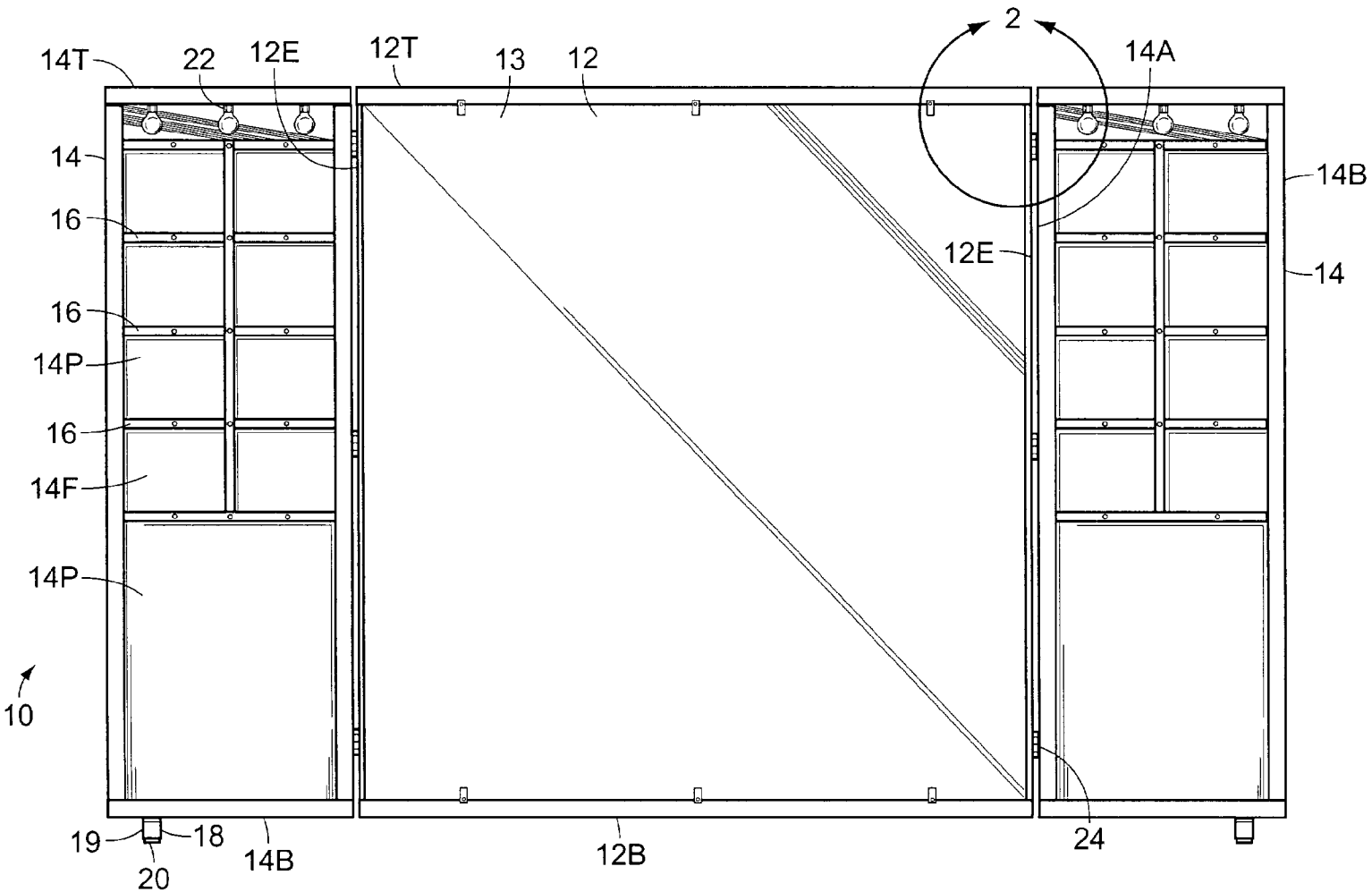
FIG. 1 is a front elevational view of the room partition system in an extended position, wherein the lateral storage units are swiveled alongside the central connecting panel.

FIG. 1 illustrates a front elevational view of the room partition system 10, comprising a substantially rectangular central connecting panel 12 and two attached lateral storage units 14. The connecting panel 12 has two vertical edges 12E, a top edge 12T, a bottom edge 12B, a front surface, and a rear surface. In FIG. 1, the front surface of the connecting panel 12 is substantially obscured by a large mirror 13. Viewing FIG. 1 in conjunction with FIG. 3, each lateral storage unit 14 has a hinged wall 14A, a free wall 14B, a rear surface 14R, a bottom 14B, and a top 14T, which together define a storage volume for storage of various items. Each storage unit 14 further has a front 14F having openings 14P and having shelves 16. These openings 14P are used by a user to access the storage volume, and to store items upon the shelves 16 of the storage units 14.

Figure 6:
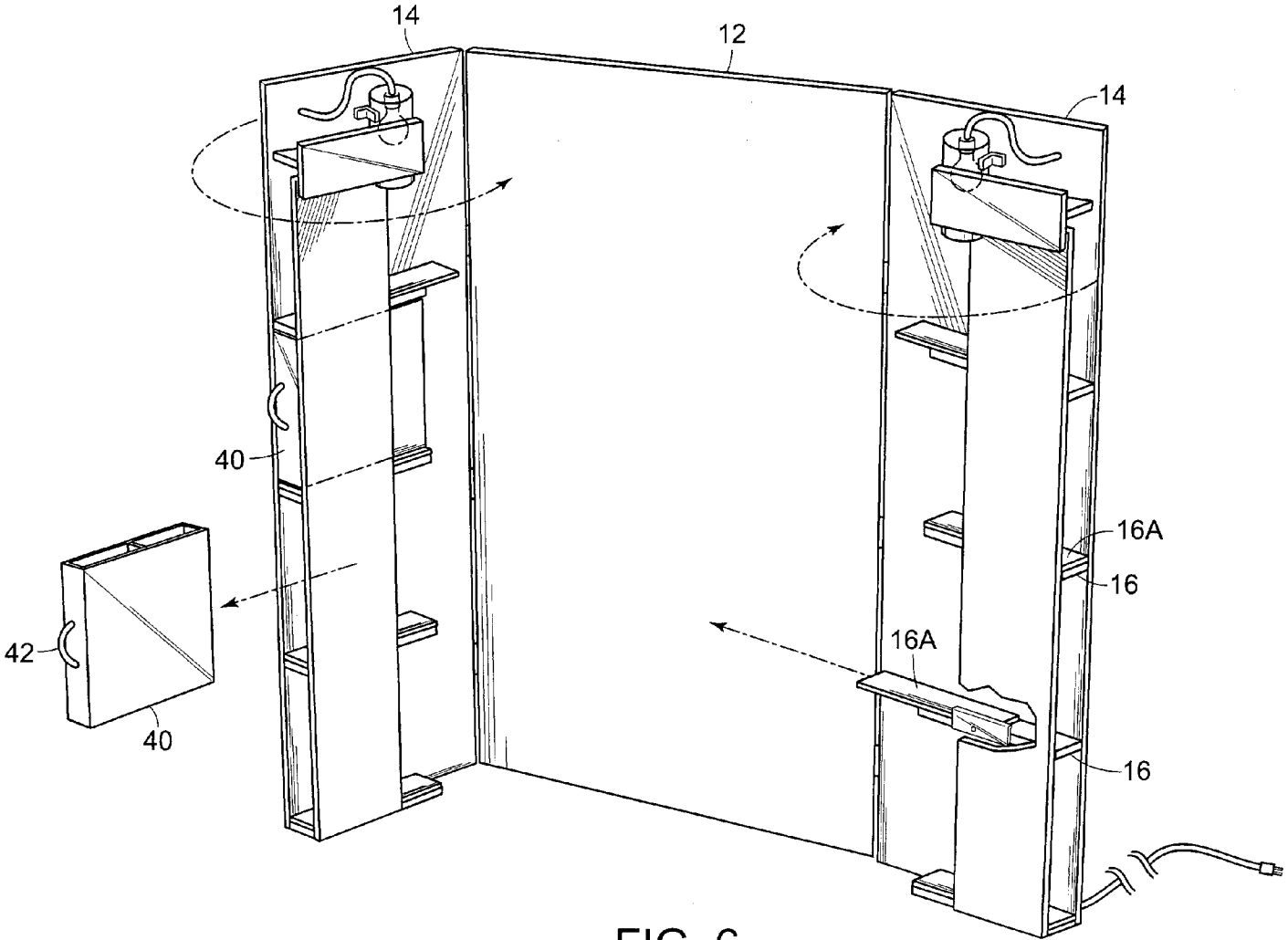
FIG. 6 is a perspective view of an embodiment of the room partition system, wherein one lateral storage unit has been extended from the central connecting panel and wherein the other lateral storage unit has been partially extended from the central connecting panel.

Each lateral storage unit 14 is attached by two hinges 24 at its hinged wall 14A, near the front 14F of the storage unit 14, to one of the vertical edges 12E of the central connecting panel 12. The room partition system 10 has an extended position, a fully folded position, and a spectrum of partially folded positions intermediate between the extended position and the fully folded position. FIG. 1 illustrates the room partition system 10 in its extended position, wherein the two lateral storage units 14 have been swiveled upon their hinges 24 away from the central connecting panel 12, such that the storage units 14 extend parallel to the panel 12, and the front 14F of the storage units 14 are substantially aligned with the panel 12. Turning momentarily to FIG. 6, one of the lateral storage units 14 is shown in a partially folded position, and the other lateral storage unit 14 is shown in an extended position. A user extends or folds the lateral storage units 14 depending upon the particular needs of the user and the shape of the room in which the room partition system 10 has been situated. When the lateral storage units 14 are folded perpendicularly to the panel 12, the room partition system 10 may be used as an entertainment center, a study center, or a work center, as will be described. When the room partition system 10 is fully folded, the front 14F of each of the lateral storage units 14 is flush against the front surface of the connecting panel 12, thereby allowing the room partition system 10 to be compactly stored.

Returning to FIG. 1, the bottom 14B of each lateral storage unit 14 has an attached wheel assembly 19. Each wheel assembly 19 has casters 18 having wheels 20. The wheels 20 enable the room partition system 10 to be easily rolled to any desired location within the room. This feature has a number of advantages. For example, it permits the user to roll the room partition system 10 out of the way when a floor of the room needs to be cleaned. Additionally, it permits the user to position the room partition system 10 flush against the walls of the room when the room partition system 10 is not being used for partitioning the room into an additional enclosed area.

Figure 5:
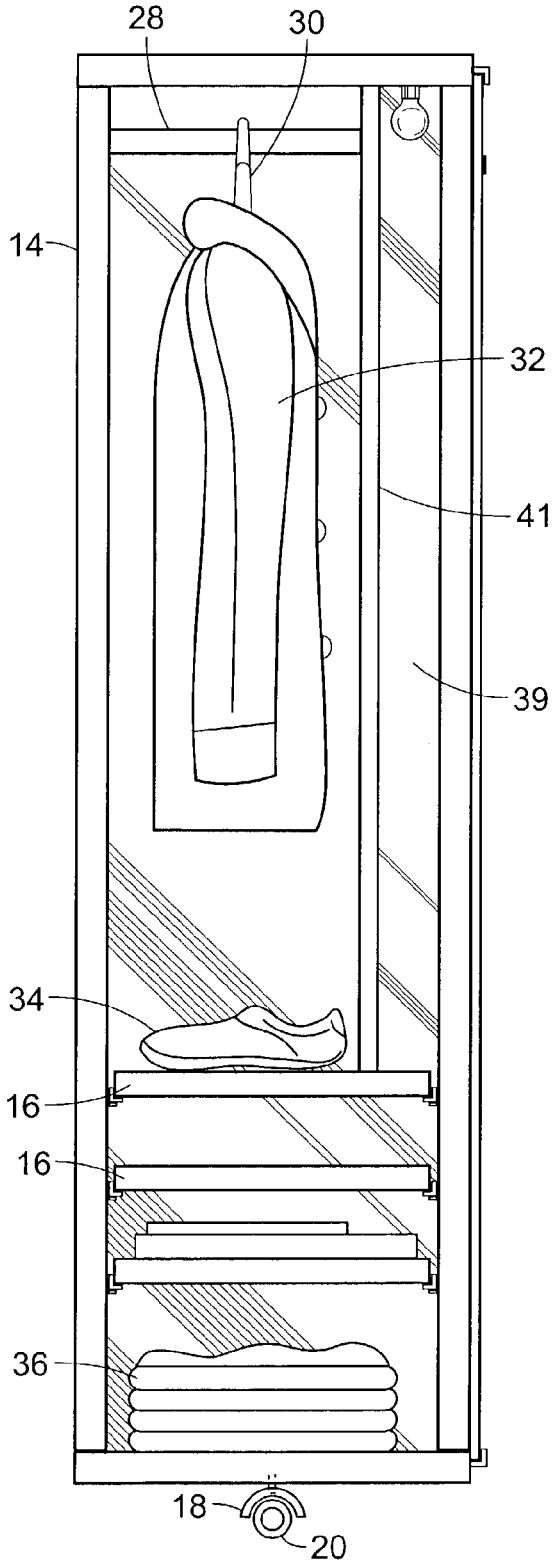
FIG. 5 is a front elevational view of one of the lateral storage units being used to hold various items of clothing.

FIG. 1 illustrates that each lateral storage unit 14 has a plurality of horizontal shelves 16 extending between the rear surface 14R of the storage unit 14 and the front 14F of the storage unit 14. Turning to FIG. 5, the shelves 16 of one of the lateral storage units 14 are being used for holding various items, including shoes 34 and towels 36. The lateral storage unit 14 also has a horizontal bar 28 for holding a plurality of hangers 30. The hangers 30 are used for hanging items of clothing, such as a jacket 32, thus enabling the lateral storage units 14 to be used as a wardrobe organizer. The mirror 13 positioned on the front surface of the central connecting panel 12 allows the user to view him/herself after putting on various items of clothing contained within the wardrobe organizer.

Figure 2:
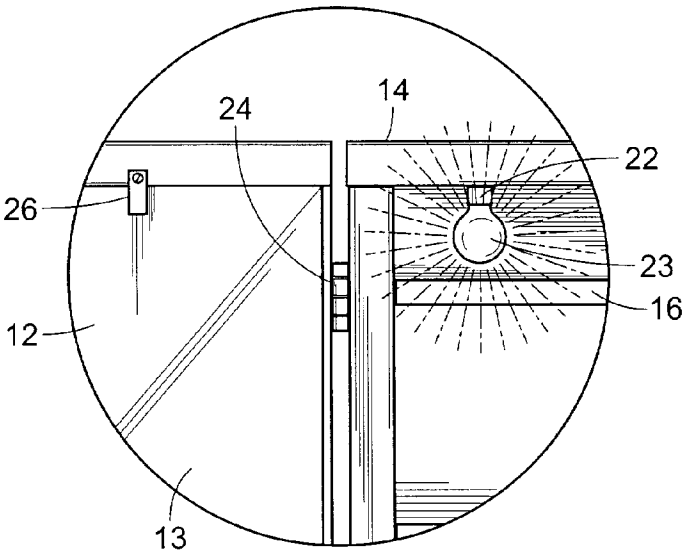
FIG. 2 is an enlarged front elevational view of one of the hinges which attaches one of the lateral storage units to the central connecting panel, taken generally in the area of circle 2 in FIG. 1.

FIG. 2 illustrates an enlarged view of one of the hinges 24 which connects the central connecting panel 12 to one of the lateral storage units 14. The central connecting panel 12 has a plurality of mirror mounting brackets 26 for holding the mirror 13 firmly in place against the front surface of the central connecting panel 12. The lateral storage units 14 each have a shelf 16 for containment therein of a light fixture 22 for illumination of the area surrounding the room partition system 10. A variety of shelving designs are contemplated for containment of variously sized and shaped lighting fixtures. In this regard, FIG. 5 illustrates a shelving design wherein the lateral storage unit 14 has a vertical inner wall 41 for defining a hollow cavity 39 for containment therein of a fluorescent light fixture which may extend substantially from the top 14T of the lateral storage unit 14 to the bottom 14B of the lateral storage unit 14.

Figure 3:
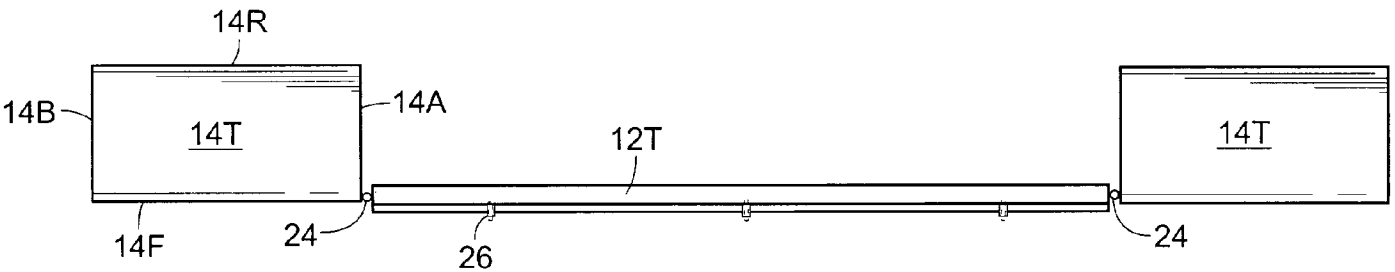
FIG. 3 is a top plan view of the room partition system in the extended position of FIG. 1.

FIG. 3 illustrates a top plan view of the room partition system 10 wherein the top 14T of the lateral storage units 14 and the top 12T of the central connecting panel 12 are visible. Here, the room partition system 10 is shown in an extended position.

Figure 4:
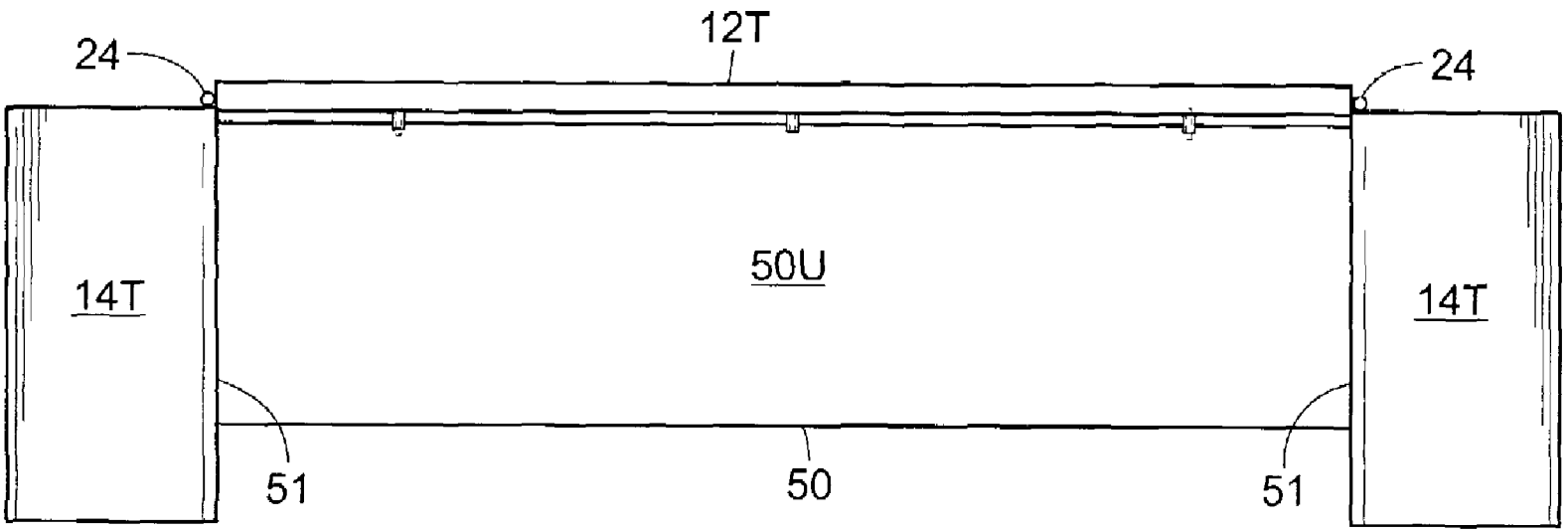
FIG. 4 is a top plan view of the room partition system in a partially folded position, wherein the storage units are perpendicular to the central connecting panel, and wherein a connecting shelf is positioned between and supported by the two lateral storage units.

FIG. 4 illustrates a top plan view of the room partition system 10 wherein the room partition system 10 is shown in a partially folded position. Each lateral storage unit 14 has at least one middle slot 51 for selectively removably accepting a connecting shelf 50 therebetween, when the storage units 14 are perpendicular to the central connecting panel 12 and facing each other. For that reason, any such 'pair' of middle slots 51 are located at the same height on their respective storage units 14. The connecting shelves 50 each have a horizontal upper surface 50U for supporting the weight of a television set, a stereo system, a compact disk player, a videocassette recorder, and a DVD player, thereby allowing use of the room partition system 10 as an entertainment center. The connecting shelves 50 are spaced apart at a suitable distance for holding the various components of the entertainment center. In this regard, each lateral storage unit 14 is also equipped with a sliding CD storage drawer 40 having a handle 42, for containment therein of a plurality of CDs, for use with the CD player of the entertainment system. FIG. 6 additionally illustrates telescoping shelf extensions 16A which selectively overlap its associated shelf 16 or may be optionally extended laterally therefrom in the direction of the central connecting panel 12, when the relative orientation of the connecting panel 12 and storage unit 14 permits such extension.

In conclusion, herein is presented a room partition system. The invention is illustrated by example in the drawing figures, and throughout the written description. It should be understood that numerous variations are possible, while adhering to the inventive concept. Such variations are contemplated as being a part of the present invention.

What is claimed is:

1. A room partition system, for dividing a room into separate areas, comprising:

a substantially flat rectangular central connecting panel having two vertical edges, a top edge, a bottom edge, a front surface, and a rear surface;

two lateral storage units, each having a hinged wall, a free wall, a front, a rear surface, a bottom having an attached wheel assembly having casters having wheels, thereby allowing the room partition system to be easily rolled to any desired location within the room, and a top, which together define a storage volume for storage of various items, wherein each lateral storage unit is connected at its front by at least one hinge, at its hinged wall, to one of the vertical edges of the central connecting panel, wherein:

each lateral storage unit has a plurality of horizontal shelves extending between the rear surface of the storage unit and the front of the storage unit, for holding various items of clothing, thereby allowing use of each of the lateral storage units as a wardrobe organizer, each lateral storage unit has a middle slot for selectively removably accepting at least one connecting shelf between the middle slots of both lateral storage units, when the storage units are perpendicular to the central connecting panel and facing each other, the middle slots of each pair are located at the same height on their respective storage units, and wherein the at least one connecting shelf is capable of supporting the weight of at least one item selected from the group consisting of a television set, a stereo system, a compact disk player, a videocassette recorder, and a DVD player, thereby allowing use of the room partition system as an entertainment center, each lateral storage unit is equipped with at least one shelf for containment therein of a light fixture, for illumination of the area surrounding the room partition system, and at least one of the lateral storage units has a horizontal bar for holding a plurality of hangers for hanging items of clothing, thereby enabling more efficient use of the lateral storage unit as a wardrobe organizer; and wherein the interconnection of the storage units and connecting panel allows the room partition system to selectively have:

an extended position, wherein the two lateral storage units have been extended upon their hinges away from the central connecting panel, such that the storage units extend parallel to the panel, and the front of the storage units are substantially aligned with the panel, a fully folded position, wherein the front of each of the lateral storage units is flush against the front surface of the connecting panel, thereby allowing the room partition system to be compactly stored, and a spectrum of partially folded positions intermediate between the extended position and the fully folded position, including a position wherein the lateral storage units are positioned perpendicular to the connecting panel, thereby allowing the room partition system to be used as an entertainment center, a study center, or a work center.

2. The room partition system as recited in claim 1, wherein each lateral storage unit is equipped with a sliding CD storage drawer-having a handle, for containment therein of a plurality of CDs; for use with the entertainment system.

3. A method of using a room partition system by a user, in conjunction with a room having a floor, for dividing the room into an additional enclosed area, said room partition system having a substantially flat rectangular central connecting panel having two vertical edges, a front surface, and a rear surface, said room partition system also having two lateral storage units, each having a hinged wall, a free wall, a rear surface, a front, a bottom, and a top, which together define a storage volume for storage of various items, wherein each of said lateral storage units has a plurality of horizontal shelves for holding a variety of items, wherein each lateral storage unit is connected by at least one hinge, at its hinged wall, to one of the vertical edges of the central connecting panel, wherein said bottom of each lateral storage unit has an attached wheel assembly for rolling the room partition system to any desired location within the room, wherein each lateral storage unit has at least one middle slot for selectively removably accepting a connecting shelf therebetween, when the storage units are perpendicular to the central connecting panel and facing each other, and wherein each of the lateral storage units is equipped with at least one lighting fixture shelve for containment therein of at least one lighting fixture, said room partition system having an extended position, wherein the two lateral storage units have been extended upon their hinges away from the central connecting panel, such that the storage units extend parallel to the panel, and the front of the storage units are substantially aligned with the panel, said room partition system also having a fully folded position, wherein the front of each of the lateral storage units is flush against the front surface of the connecting panel, thereby allowing the room partition system to be compactly stored, and said room partition system also having a spectrum of partially folded positions intermediate between the extended position and the fully folded position, including a position wherein the lateral storage units are folded perpendicularly to the panel, said method comprising the steps of:

a) positioning the at least one wheel assembly of each of the lateral storage units on the floor of the room, with the central connecting panel and the lateral storage units extending vertically upward from the floor;

b) extending the lateral storage units away from the connecting panel in order to unfold the room partition system;

c) rolling the room partition system upon its wheel assemblies to a desired location on the floor of the room, and thereby dividing the room into an additional enclosed area;

d) storing various items of clothing upon the shelves, and thereby using the lateral storage units as a wardrobe organizer;

e) removing the items of clothing by the user as needed;

f) folding the room partition system to the fully folded position for storage, when no longer needed for dividing the room;

g) swiveling the lateral storage units on their at least one hinge until the storage units are perpendicular to the central connecting panel and facing each other, while positioning the at least one connecting shelf within the opposed middle slots;

h) supporting the weight of at least one item selected from the group consisting of a television set, a stereo system, a compact disk player, a videocassette recorder, and a DVD player, on the at least one connecting shelf, thereby allowing use of the room partition system as an entertainment center; and i) illuminating the at least one lighting fixture and thereby illuminating the area surrounding the room partition system.

* * * * *